United States Patent [19]

Hewson

[11] 4,159,548

[45] Jul. 3, 1979

[54] LIFT-OFF HINGE ASSEMBLY FOR TOILETS AND THE LIKE

[75] Inventor: Clifford B. Hewson, Toronto, Canada

[73] Assignee: Moldex Limited, Barrie, Canada

[21] Appl. No.: 878,043

[22] Filed: Feb. 15, 1978

[51] Int. Cl.[2] ..... A47K 13/12; E05D 7/12

[52] U.S. Cl. ..... 4/236; 4/240; 16/128 R; 16/149; 24/230 R

[58] Field of Search ..... 4/234, 236, 237, 240; D23/71; 16/148, 128 R, DIG. 13, 149, 158, 159; 85/55, 5 R, 80; 24/214, 230 R

[56] References Cited

U.S. PATENT DOCUMENTS

| | | | |
|---|---|---|---|
| 3,179,969 | 4/1965 | Glynn | 24/214 X |
| 3,308,483 | 3/1967 | Miller | 4/236 |
| 3,590,401 | 7/1971 | Brown | 4/236 |
| 3,805,306 | 4/1974 | Stairs | 4/236 |
| 3,921,254 | 11/1975 | Foster, Jr. et al. | 16/149 X |
| 3,947,932 | 4/1976 | Flynn | 24/230 R |
| 4,023,735 | 5/1977 | LaDue | 24/230 R X |

FOREIGN PATENT DOCUMENTS

| | | | |
|---|---|---|---|
| 859353 | 12/1970 | Canada | 4/236 |
| 869751 | 5/1971 | Canada | 4/236 |
| 880005 | 9/1971 | Canada | 4/240 |
| 202671 | 3/1908 | Fed. Rep. of Germany | 16/149 |
| 346006 | 4/1931 | United Kingdom | 4/236 |

*Primary Examiner*—Stuart S. Levy

*Attorney, Agent, or Firm*—Rogers, Bereskin & Parr

[57] ABSTRACT

A lift-off hinge assembly for toilet seats and the like, consisting of a hinge block and a lift-off hinge pin. The lift-off hinge pin has a head with a pin projecting from its side and a pair of spaced parallel jaw members projecting from its end. The upper jaw member is long, flexible and has a notch across its outer surface; the lower jaw member is shorter and more rigid. The hinge block has a pair of sloping upper surfaces meeting at an apex. One such upper surface has an entry opening for the jaw members, and the other has a release opening, the two openings being separated by a bridge which engages the notch when the jaw members are inserted into the entry opening. The lift-off hinge is removed from the hinge block by depressing the upper jaw member and sliding the lift-off hinge out of the entry openings. A fastening bolt for the hinge block is accessable through the release opening when the lift-off hinge pin is removed.

8 Claims, 9 Drawing Figures

LIFT-OFF HINGE ASSEMBLY FOR TOILETS AND THE LIKE

This invention relates to a hinge assembly for use in releasably and pivotally connecting a first member such as a toilet seat and the like to a second member such as a toilet and the like.

The difficulties experienced when cleaning a toilet, particularly around the hinge members connecting the toilet seat to the toilet, are well-known, and many devices have been proposed to allow the toilet seat to be either removed or raised to facilitate cleaning. Examples of such prior art devices are shown in Canadian Pat. No. 859,353 of Dec. 29, 1970 to Waldon, Canadian Pat. No. 869,751 of May 4, 1971 to Waldon, Canadian Pat. No. 880,005 of Sept. 7, 1971 to Watson and U.S. Pat. No. 3,590,401 of July 6, 1971 to Brown.

The present invention provides a novel hinge assembly which is extremely inexpensive to manufacture, easy to install, and which permits easy removal of a toilet seat for cleaning. In its preferred form, the hinge assembly of the present invention not only can be installed on original toilet equipment, but also can easily be installed by members of the public on many existing toilets.

In an embodiment of the present invention, a hinge assembly has a lift-off hinge pin and a hinge block. The hinge pin has a head portion, a clip portion and a pin portion. The head portion has a base surface and a side surface. The clip portion is defined by first and second spaced jaw members which extend from the base surface of the head portion and have oppositely outwardly-facing surfaces. The firt jaw member is flexible and has a notch extending laterally across its outwardly-facing surface. The pin portion extends outwardly from the side surface of the head portion and is adapted to pivotally mate with a first member such as a toilet seat. The hinge block is securable to a second member such as a toilet and has a hollow interior. An entry opening in a first side of the hinge block and a release opening in a second side of the hinge block permit access to the interior. A bridge portion defining a retaining member separates the entry opening from the release opening. The entry opening is adapted to snugly receive the jaw members of the hinge pin, and the retaining member is adapted to engage with the notch on the first jaw member to mate the hinge pin to the hinge block.

Advantages that can be achieved by use of the present invention will become apparent from the following description of a preferred embodiment, considered together with the accompanying drawings in which.

Figure 1:
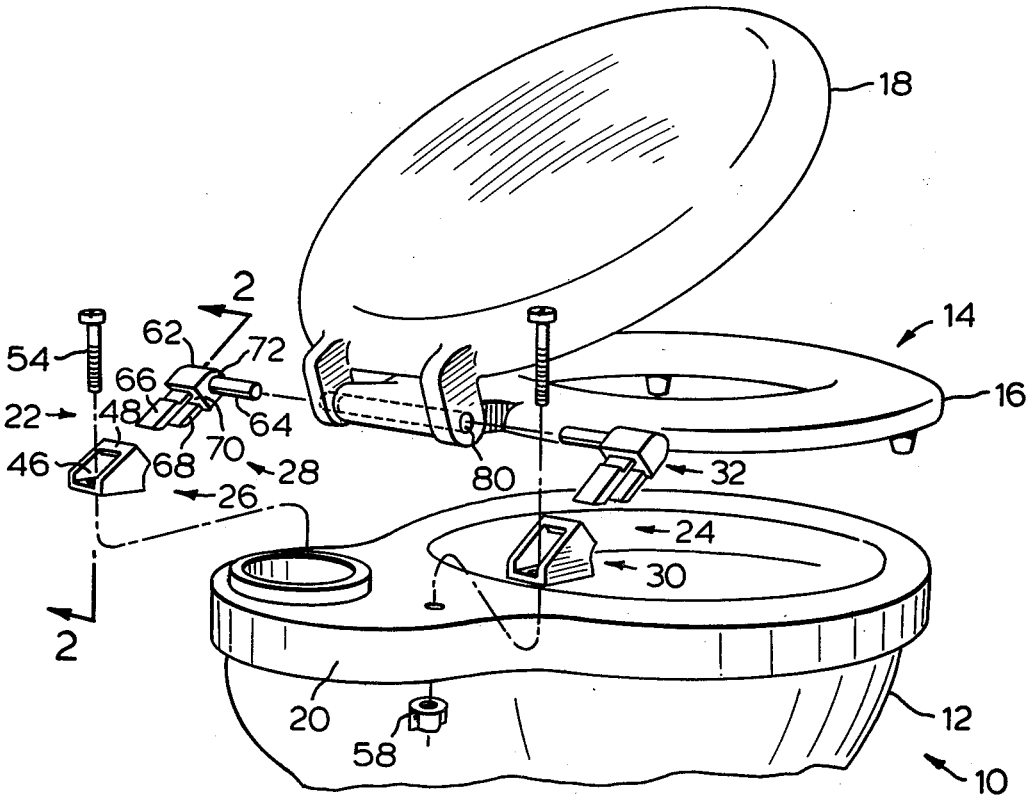
FIG. 1 is an exploded perspective view of a toilet seat releasably and pivotally connected to a toilet by two hinge assemblies constructed according to a preferred embodiment of the invention.

Reference is first made to FIG. 1 which shows a conventional toilet 10 having a bowl 12 and a seat 14 consisting of a ring 16 and a lid 18. The seat 14 is releasably and pivotally connected to a rear flange 20 of the toilet 10 by two hinge assemblies 22 and 24 constructed according to a preferred embodiment of the invention.

The hinge assembly 22 consists of a hinge block 26 and a lift-off hinge pin 28. The hinge assembly 24 consists of a hinge block 30 which is identical to the hinge block 26 and a lift-off hinge pin 32 which is a mirror image of the hinge pin 28.

Figure 5:
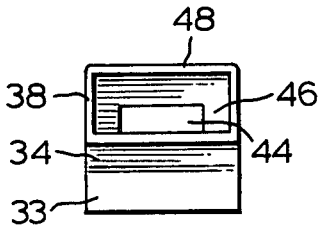
FIG. 5 is a front view of a hinge block.
Figure 6:
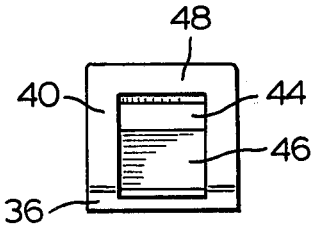
FIG. 6 is a rear view of a hinge block.

The hinge block 26 has (FIGS. 2, 5, 6) a front face consisting of a substantially vertical lower section 33 and an upwardly and forwardly sloping upper section 34, a rear face consisting of a substantially vertical section 36, and an upper face consisting of an inclined frontwardly-facing section 38 (FIG. 5) and an inclined rearwardly-facing section 40.

Figure 2:
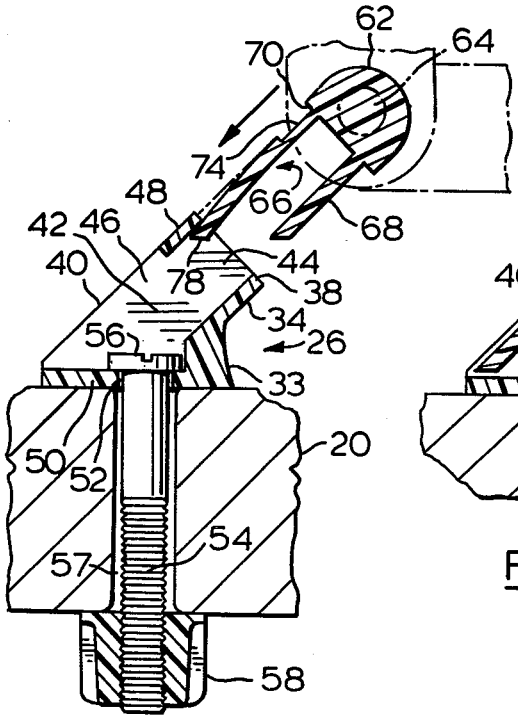
FIG. 2 is a sectional view along the line 2—2 of FIG. 1 showing the clip portion of a lift-off hinge pin being inserted into the entry opening of a hinge block.

The hinge block 26 has a hollow interior 42, as is best seen in FIG. 2. Access to the interior 42 is permitted by a rectangular entry opening 44 in the frontwardly-facing section 38 of the upper face. Access to the interior 42 is also permitted by a rectangular release opening 46 cut away from the rearwardly-facing section 40 of the upper face and from the vertical section 36 of the rear face. The entry opening 44 is separated from the release opening 46 by a rectangular bridge portion 48 which defines a retaining member.

The base 50 of the hinge block 26 is flat so that it may rest on the toilet flange 20. The base 50 includes a bolt opening 52 which is located beneath the release opening 46 so that a threaded bolt 54 can be inserted through release opening 46 into bolt opening 52. Since the bridge portion 48 interferes slightly with the head 56 of the bolt 54, the bolt opening 52 has sufficient clearance for the bolts 54 so that the bolt 54 can be inserted at an angle into opening 52 and then can be straightened to a vertical position after the bolt head 56 has passed below the bridge portion 48. (Alternatively the angle between the section 40 and the horizontal can be decreased and the section 40 lengthened slightly so that the bridge portion 48 will be located forwardly of the bolt head 56.)

To fasten the hinge block 26 to the flange 20, the bolt 54 is passed through opening 52 and through a similar bolt hole 57 in the flange 20 and is then secured with a wing nut 58.

The lift-off hinge pin 28 of the hinge assembly 22 has a head portion 62, a pin portion 64 and a clip portion defined by a first jaw member 66 and a second jaw member 68.

The head portion 62 has a planar base surface 70 and two opposed, planar, parallel side surfaces, one of which is indicated at 72 in FIG. 1. The jaw members 66 and 68 are spaced apart and are substantially parallel and extend in a substantially perpendicular direction from the base surface 70. The pin portion 64 extends in a substantially perpendicular direction from the side surface 72. The jaw members 66 and 68 are substantially perpendicular to the pin portion 64. Preferably, the first jaw member 66 is disposed upwardly of, and is slightly longer than, the second jaw member 68.

Figure 4:
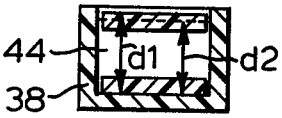
FIG. 4 is a sectional view along the line 4—4 of FIG. 3.

The perpendicular spacing d1 (FIG. 4) between the outwardly-facing surface of the first jaw member 66 and the outwardly-facing surface of the second jaw member 68 is preferably slightly greater than the perpendicular height d2 of the entry opening 44.

Figure 3:
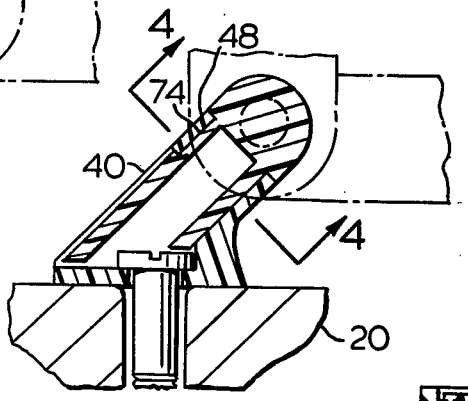
FIG. 3 is a sectional view along the line 2—2 of FIG. 1 showing the clip portion of a lift-off hinge pin fully inserted into the entry opening of a hinge block.

The first jaw member 66 is provided with a rectangular notch 74 extending laterally across its outwardly-facing surface adjacent to the base surface 70 of the head portion 62. The width of the notch 74 is equal to or very slightly greater than the width of the retaining member 48 of the hinge block 26 (FIG. 3). The first jaw member 66 is therefore more pliable than the second jaw member 68 and may be easily cantilevered towards the jaw member 68 upon the application to its outwardly-facing surface of an inwardly directed force.

The lift-off hinge pin 32 of the hinge assembly 24 differs from the lift-off hinge pin 28 of the hinge assembly 22 only in that its pin portion 76 extends from a side surface (not visible) corresponding to the left hand side surface of the head portion 62.

The lift-off hinge pin 28 is mated to the hinge block 26 by inserting the jaw members 66 and 68 into the entry opening 44. Since the first upper jaw member 66 is preferably longer than the second lower jaw member 68, it is inserted into the entry opening 44 first and is cantilevered inwardly by pressing on its outwardly-facing surface to decrease the spacing between its outwardly-facing surface and the outwardly-facing surface of the lower jaw member 68 (FIG. 2) so that it is possible to insert the lower jaw member 68 into the entry opening 44.

If the lower jaw member 68 is provided with a bevelled end portion 78, it is not necessary to press downwardly on the outwardly-facing surface of the first upper jaw member 66 since the bevelled end portion 78, as it slides into the entry opening 44, causes the upper jaw member 66 to deflect inwardly towards the lower jaw member 68.

The jaw members 66 and 68 are inserted into the entry opening 44 until the notch 74 passes under the retaining member 48, at which time the upper jaw member 66 springs upwardly and the retaining member 48 engages the notch 74.

When the notch 74 is in engagement with the retaining member 48, the outwardly-facing surface of the upper jaw member 66 is readily accessible through the release opening 46. To disengage the notch 74 from the retaining member 48, the first upper jaw member 66 is deflected inwardly towards the second lower jaw member 68 by pressing on its outwardly-facing surface, thereby allowing the jaw members 66 and 68 to be removed from the entry opening 44.

The hinge assemblies 22 and 24 may be used with many conventional toilets simply by replacing the hinge members connecting a seat to the toilet with the present hinge assemblies, the pin portions 64 and 76 being inserted into socket portion 80 of the seat. The pin portions 64 and 78 are preferably made long enough so that both ring 16 and lid 18 of the seat 14 can pivot on them.

The hinge assemblies 22 and 24 are preferably injection molded from polyethylene or other appropriate plastic.

Various modifications may be made to the hinge assemblies 22 and 24. For instance, the orientation of the assemblies 22 and 24 may be reversed so that the entry slot opening 44 faces rearwardly rather than frontwardly. In the frontward orientation, the release opening 46 may be disposed on the front face below the entry opening 44, in which case the first jaw member 66 having the notch 74 would be disposed below the second jaw member 68. In that event the bolt 54 is preferably molded integrally with the hinge block 26.

Figure 7:
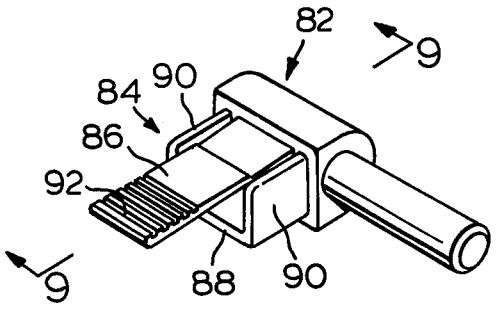
FIG. 7 is a perspective view of another embodiment of a lift-off hinge pin according to the invention.
Figure 8:
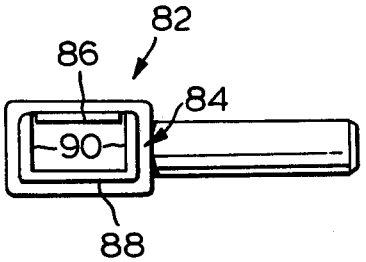
FIG. 8 is a rear view of the hinge pin of FIG. 7.
Figure 9:
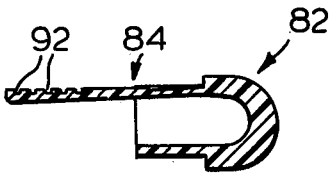
FIG. 9 is a sectional view along the line 9—9 of FIG. 7.

Reference is next made to FIGS. 7, 8, and 9 which show a slightly modified hinge pin 82 according to the invention. The hinge pin 82 differs from hinge pin 28 only in its clip portion 84. Clip portion 84 includes a first upper long jaw member 86 and a second short lower jaw member 88 which is reinforced by two side members 90 molded integrally with the jaw member 88 to form a kind of three sided box structure. This arrangement gives great rigidity to the lower jaw member 88 while permitting use of relatively thin plastic, and ensures that all the flexing will be performed by the flexible upper jaw number 86. The outer end of the upper jaw member 86 may be provided with transverse serrations 92 on its outer surface to assist the user in depressing this surface and sliding it.

What I claim as my invention is:

1. A hinge assembly for use in releasably and pivotally connecting a toilet seat or lid to a toilet, comprising:

(a) a lift-off hinge pin having (i) a head portion having a base surface and a side surface, (ii) a clip portion extending from the base surface of the head portion and consisting of a flexible first jaw member having an outwardly-facing surface and a second jaw member having an oppositely outwardly-facing surface spaced from the outwardly-facing surface of the first jaw member, the first jaw member having a notch extending laterally across its outwardly-facing surface, and (iii) a pin portion extending from the side surface of the head portion and adapted to pivotally mate with a toilet seat or lid, and (b) a hinge block securable to a toilet, the hinge block having (i) a hollow interior, (ii) a substantially flat lower exterior surface for contacting said toilet when said hinge block is secured to said toilet (iii) a pair of solid walls extending upwardly and forwardly from said substantially flat lower surface, (iv) a first side facing upwardly and forwardly adapted to be brought into proximity with the base surface of said hinge pin, the said side having an entry opening permitting access to the interior and adapted to snugly receive the jaw members of the hinge pin, (v) a second side facing upwardly and rearwardly having a release opening permitting access to substantially the entire interior of said hinge block for cleaning purposes, and a bridge portion separating the entry opening of the said first side from the release opening in the said second side, the bridge portion defining a retaining member, so that, when the jaw members of the hinge pin are snugly received by the entry opening of the hinge block, the notch on the outwardly facing surface of the first jaw member engages the retaining member to mate the hinge pin to the hinge block, the outwardly facing surface of the first jaw member then being accessible through the release opening so that, upon the inward deflection of the first jaw member towards the second jaw member, the notch is released from engagement with the retaining member, thereby allowing the hinge pin to be removed from the hinge block, and (vi) the first jaw member being dimensioned to close substantially entirely the release opening when the hinge pin is mated with the hinge block.

2. The hinge assembly as defined in claim 1 wherein the notch in the outwardly-facing surface of the first jaw member is disposed adjacent to the base surface of the head portion of the hinge pin.

3. The hinge assembly as defined in claim 2 wherein the width of the notch in the outwardly-facing surface of the first jaw member is slightly greater than the width of the retaining member of the hinge block.

4. The hinge assembly as defined in claim 3 wherein the second jaw member comprises a three-sided box structure opening upwardly toward said first jaw member.

5. The hinge assembly as defined in claim 3 wherein the jaw members are substantially parallel.

6. The hinge assembly as defined in claims 5 or 4 wherein the perpendicular spacing between the outwardly-facing surfaces of the jaw members when the first jaw member is unstressed is slightly greater than the perpendicular height of the entry opening of the hinge block.

7. The hinge assembly as defined in claims 5 or 4 wherein said hinge block is secured to said toilet by means of bolt means projecting from said substantially flat lower surface of said hinge block and said bolt passes through an opening in said substantially flat lower surface which is aligned with and located beneath the release opening so that a bolt may be inserted into the bolt opening through the release opening.

8. In combination, a toilet;

having a substantially flat upper surface for mounting a pair of spaced hinge assemblies which assemblies pivotally and releasably affix a toilet seat and lid to the toilet, said upper surface of said toilet adapted to contact a substantially flat lower surface of a hinge block of each of said assemblies such that when each said hinge block is affixed to said toilet there is no well or cavity in which fluid may be retained;

and a pair of hinge assemblies each assembly comprising a hinge pin having:

(a)

(i) a head portion having a base surface and a side surface, (ii) a clip portion extending from the base surface of the head portion and consisting of a flexible first jaw member having an outwardly-facing surface and a second jaw member having an oppositely outwardly-facing surface spaced from the outwardly-facing surface of the first jaw member, the first jaw member having a notch extending laterally across its outwardly-facing surface, and (iii) a pin portion extending from the said surface of the head portion and adapted to pivotally mate with a toilet seat or lid, and (b) a hinge block securable to the toilet, the hinge block having:

(i) a hollow interior, (ii) a substantially flat lower exterior surface for contacting said toilet when said hinge block is secured to said toilet, (iii) a pair of solid walls extending upwardly and forwardly from said substantially flat lower surface, (iv) a first side facing upwardly and forwardly adapted to be brought into proximity with the base surface of said hinge pin, the said side having an entry opening permitting access to the interior and adapted to snugly receive the jaw members of the hinge pin, (v) a second side facing upwardly and rearwardly having a release opening permitting access to substantially the entire interior of said hinge block for cleaning purposes, and a bridge portion separating the entry opening of the said first side from the release opening in the said second side, the bridge portion defining a retaining member, so that, when the jaw members of the hinge pin are snugly received by the entry opening of the hinge block, the notch on the outwardly facing surface of the first jaw member engages the retaining member to mate the hinge pin to the hinge block, the outwardly facing surface of the first jaw member then being accessible through the release opening so that, upon the inward deflection of the first jaw member towards the second jaw member, the notch is released from engagement with the retaining member, thereby allowing the hinge pin to be removed from the hinge block, and (vi) the first jaw member being dimensioned to close substantially entirely the release opening when the hinge pin is mated with the hinge block, the axes of the pin portion of the hinge assemblies are arranged to be collinear when mounted on the toilet whereby any liquid falling on said hinge assemblies may drain towards said flat surface from which the liquid may be readily cleaned.

* * * * *